United States Patent [19]

Goldner

[11] 4,129,962

[45] Dec. 19, 1978

[54] DEVICE ADAPTED FOR SELF-DETERMINING, UNPREDICTABLE VARIATIONS IN MOVEMENT

[76] Inventor: Richard Goldner, 3717 Toad Lake Rd., Bellingham, Wash. 98225

[21] Appl. No.: 725,465

[22] Filed: Sep. 22, 1976

[51] Int. Cl.[2] ..... A63H 13/00

[52] U.S. Cl. ..... 46/120

[58] Field of Search ..... 46/119, 120

[56] References Cited

U.S. PATENT DOCUMENTS

| | | | |
|---|---|---|---|
| 1,872,544 | 8/1932 | Williams | 46/120 |
| 2,218,772 | 10/1940 | Sowin | 46/119 X |
| 2,874,513 | 2/1959 | Connell | 46/119 |

FOREIGN PATENT DOCUMENTS

| | | | |
|---|---|---|---|
| 334373 | 9/1930 | United Kingdom | 46/119 |
| 642713 | 9/1950 | United Kingdom | 46/119 |

*Primary Examiner*—F. Barry Shay

*Attorney, Agent, or Firm*—Reed, Smith, Shaw & McClay

[57] ABSTRACT

The invention disclosed herein is for a device adapted for self-determining, unpredictable variations in movement, which is preferably configured to include at least one figurine. The device comprises a base having at least one opening therethrough and a flexible member rotatably mounted to the base. Means for rotating said flexible member is mounted to the base and operably connected to said flexible member through said opening and may include manual or motorized drive elements. Positioned substantially coextensively within the flexible member is a deformable wire mounted to said means for rotation and optionally to a body element. A body member, such as a torso of a figurine, frictionally engages at least a portion of the flexible member and is rotatable therewith. Preferably, a means for obstructing rotation, such as a second similar device or a stationary object is mounted to the base and positioned in the rotational path of at least a portion of the first device so that contact is made between said devices during at least a portion of the arc through which the flexible member rotates causing unpredictable variations in at least the first device.

10 Claims, 8 Drawing Figures

DEVICE ADAPTED FOR SELF-DETERMINING, UNPREDICTABLE VARIATIONS IN MOVEMENT

FIELD OF THE INVENTION

The present invention relates to a novel device adapted for self-determining, unpredictable movement having particular utility as a toy figurine and other like objects.

BACKGROUND OF THE INVENTION

Various types of movable or articulating toy figurines are known in the art. Many of these toys are actuatable, either manually or by means of electrical or mechanical drive mechanisms, to perform a pre-determined movement or set of movements.

It is an objection of the present invention to provide a device which may be manually or mechanically actuated to provide self-determined but unpredictable movement, preferably by interaction with stationary or moving obstructions integral with the device. A further object of the present invention is to provide a device having two or a plurality of figurines adapted to interact and produce unpredictable varying movements that are interesting, pleasing to view and often humorous.

SUMMARY OF THE INVENTION

Generally, the present invention comprises a base member having at least one opening therethrough and a flexible, deformable member rotatably mounted to and extending from said base. Means for rotating said flexible member is mounted to the base and operably connected to said flexible member through said opening in the base. Said means may comprise a hand crank, mechanical or electric motor drive for rotating the flexible member about its axis. While its preferable to utilize a flexible member which is also deformable, deformable wire may be used where the member is not deformable. In such a case the deformable wire is positioned substantially co-extensively within said flexible member and is connected at one of its ends to said means for rotating the member and optionally connected at its other end to a body element. A body member, such as the torso of the figurine, frictionally engages at least a portion of said flexible member.

The elongated flexible member may comprise a helical coil made of wire or plastic material or a pliable tube manufactured from plastic or rubber material. Also useful in the present invention are those materials which are both flexible and deformable. It is preferable that deformation occur with little force being applied, but that the material not deform under its own weight.

In a preferred embodiment, the flexible member is frictionally engaged by a body member so as to visually bifurcate the flexible member to comprise one of the legs and one of the arms of a figurine. A second flexible member or slim rigid member passes through the body member to comprise a second leg and a second arm of the figurine. The second flexible member may be adapted for rotation, either dependent or independently of the first flexible member, in which case the second flexible member would frictionally engage the body member. Where the flexible member is not deformable, it is preferred that at least a portion of each flexible member adapted for rotation include a deformable wire which is connected to the means for rotation and positioned co-extensively within the flexible member.

In a device where only one flexible member is adapted for rotation, the means for obstructing rotation comprises a stationary object which is positioned on the base member so as to make contact with the rotatable flexible member during at least a portion of the rotation of said member. Where two or more rotatable flexible members are positioned on the base member to comprise the means for obstructing rotation, frictional interaction between the respective flexible member and the body member is sufficient, and no stationary object is necessary. The rotation of two or more flexible members by frictional interaction with the body members provides a self-determining, unpredictable movement of the objects. While not necessary, the use of a stationary object provides further variation in the movement. The rotation of a single flexible member and the frictional interaction between the body member and flexible member and with a fixed stationary object mounted to the base provides movements which vary from those associated with two or more rotatable flexible members without a stationary object.

Other advantages of the present invention will become apparent from a persual of the following detailed description of the presently preferred embodiments of the best mode of the invention taken in connection with the accompanying drawings.

PRESENTLY PREFERRED EMBODIMENTS

Figure 1:
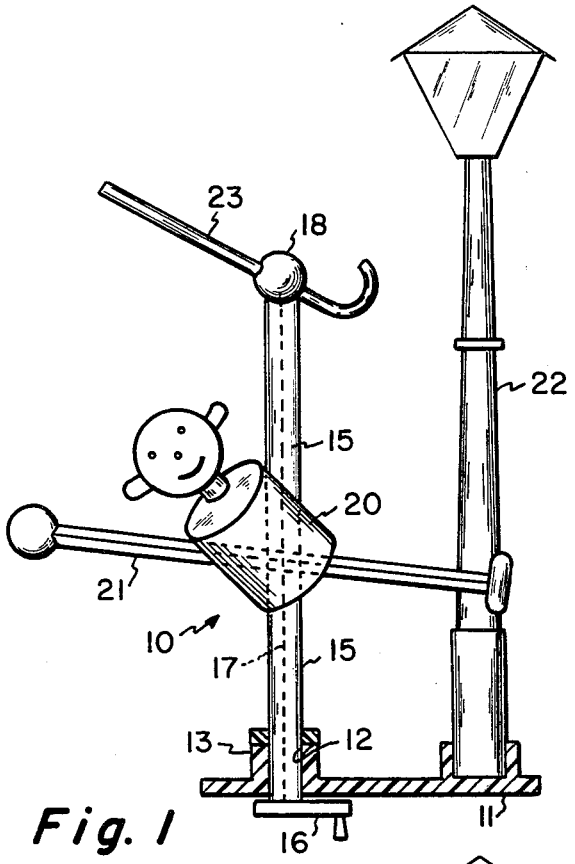
FIG. 1 is an elevation view of a device having one flexible rotatable member and a stationary object.

With reference to FIG. 1, device 10 is shown in the form of a figurine having a base 11 with opening 12 extending therethrough. A flexible member 15 is rotatably mounted in opening 12 by means of bearing member 13. Means 16 for rotating flexible member 15 is mounted to base 11. Positioned substantially co-extensively within flexible member 15 is deformable wire 17 connected to rotation means 16 and body element 18, shown as a hand. Where flexible member 15 is deformable as well as flexible, deformable wire 17 may be omitted.

Body member 20 frictionally engages flexible member 15 for rotation therein. As shown, body member 20 comprises the torso of a figurine and visually bifurcates member 15 such that flexible member 15 comprises one of the arms and one of the legs of the figurine. Also positioned through body member 20 is a second member 21 which comprises the second arm and second leg of the figurine which may be either flexible or rigid.

Preferably, however, member 21 is flexible and is positioned to engage stationary object 22 mounted to base 11. Also, mounted to body element 18 securely attached to deformable wire 17 is protruberance 23, shown as a walking stick, positioned so as to strike object 22.

Rotation of means 16 causes flexible member 15 to rotate and, in turn, body member 20 rotates. As figurine 10 rotates, either second member 21 or proturberance 23 will strike object 22 causing an impediment to further rotation of the figurine. Flexible member 15 will continue to rotate such that either it or second member 21 deforms to bypass object 22. The deformed figurine will rotate in different configuration until it strikes object 22 on the next revolution.

Figure 2:
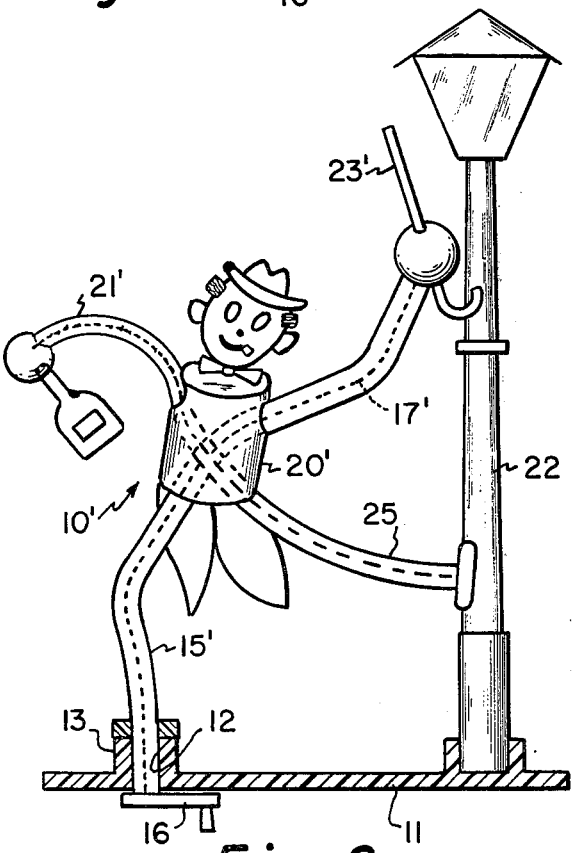
FIG. 2 is an elevation view of a device having first and second flexible members wherein only said first member is rotatable.

With reference to FIG. 2, figurine 10' is substantially identical to figurine 10 of FIG. 1, except that second flexible member 21' includes deformable wire 25 positioned co-extensively within member 21'. In both cases, rotation of means 16 causes member 15 to rotate until impeded by member 21 or protruberance 23 striking the obstacle 22. Depending upon the resiliency or rigidity of member 21 and 21' it will by-pass the obstacle if it is very soft or pliable so that the resistance to rotation is less than the frictional force between member 15 and body member 20. However, if the resistance is greater than the frictional force, the member will rotate within the body member and the arm portion of flexible member 15 and 15' will appear to wield the "walking stick," protruberance 23 and 23'. Further, different positions are obtained if the rotation of members 15 and 15' are impeded by protruberance 23 striking obstacle 22. The result is a torque which will sooner or later cause temporary or permanent deformation of the shaft to deflect it around obstacle 22. On the other hand, protruberance 23 can be made deformable so that a temporary or permanent deformation to "the walking stick" occurs rather than deformation of members 15, 15'.

By positioning deformable wire 25 within flexible member 21', FIG. 2, further variations to the movement can be made to occur by deforming member 21' or by deformations that may occur when members 21' strikes obstacle 22'.

Figure 3:
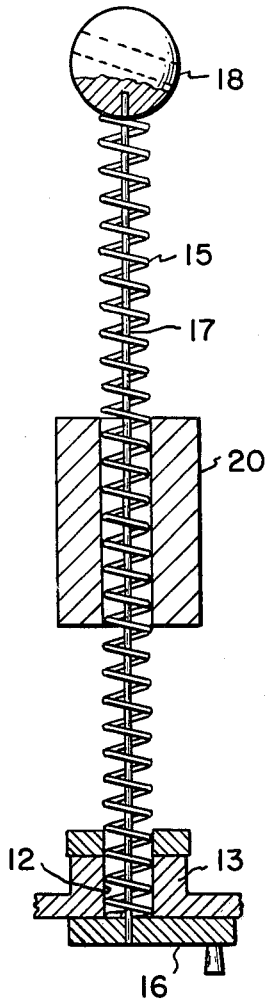
FIGS. 3–4 are enlarged sectional elevations of a flexible member and deformable wire positioned therein.
Figure 4:
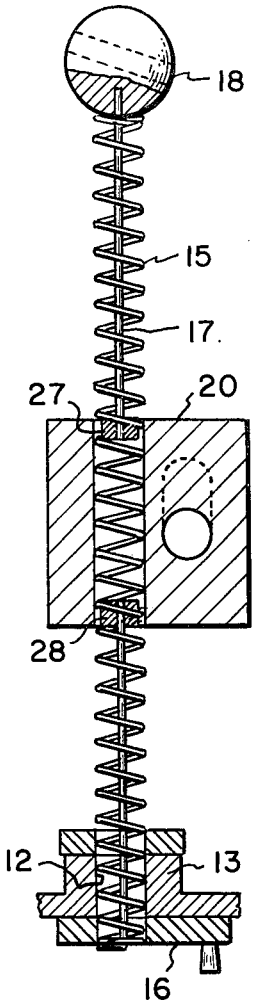

With respect to FIGS. 3 and 4, presently preferred embodiments of flexible member 15 and deformable wire 17 are shown. FIG. 3 shows a rotatable flexible member comprising a wire coil frictionally engaged by body member 20. While helical coils, either wire or plastic are preferred, pliable tube made from plastic or rubber or other suitable materials such as torsion bars, torsion springs or the like may be utilized to provide a flexible member. Wire 17 may extend throughout the length of flexible member 15 or may extend only throughout a portion of said length, as shown in FIG. 4. As shown in FIG. 4, plugs 27 and 28, which are free to rotate, are used to provide a discontinuity of wire 17 through body member 20. Discontinuity of wire 17 provides additional deformations upon the frictional interaction of members 21 and 21' or proturberances 23 and 23'.

Body element 18 may be rigidly or frictionally engaged to flexible member 15. Where frictionally engaged, member 15 may rotate, relative to element 18, about its axis when an impeding force caused by proturberance 23 striking obstacle 22 (FIG. 1) held by body element 18 is greater than the frictional force of engagement. Flexible member 15 and wire 17 are rigidly attached to rotation means 16 which may comprise a hand crank or knob, as shown, for manual operation or a rack and pinion, worm gear, bevel gear and the like or spring loaded wind-up mechanism for mechanical operation or an electrical motor.

Figure 5:
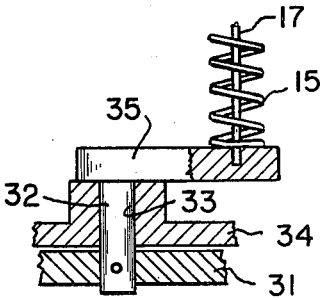
FIG. 5 is an enlarged view of a gear arrangement for simultaneously driving a device having two rotatable flexible members.

With respect to FIG. 5, a gear 31 is shown attached to shaft 32 which extends through opening 33 in base 34. Mounted for rotation with shaft 32 is eccentric arm 35 to which a flexible member and deformable wire are attached. Utilization of eccentric arm 35 is particularly advantageous where two or more flexible members are adapted for rotation to comprise the obstruction means. Eccentric arm 35 provides additional motion for interaction with both rigid obstacles and between members having two or more rotating flexible members.

Figure 6:
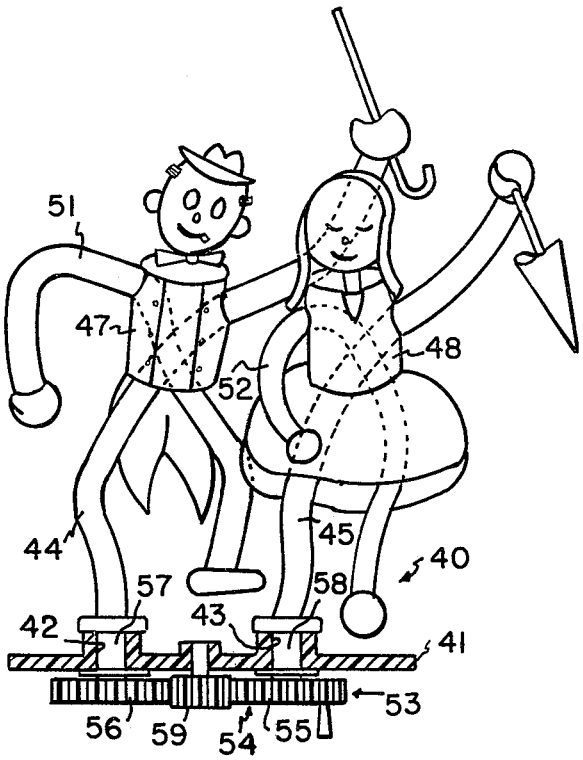
FIG. 6 is an elevation of two figurines mounted to a common base each having one flexible rotatable member.

With respect to FIG. 6, device 40 includes base 41 having openings 42 and 43 therethrough. First and second flexible rotatable members 44 and 45, respectively, are positioned through openings 42 and 43, respectively. Flexible member 44 and 45 may be deformable or may include deformable wires (not shown) extending co-extensively therewithin as shown either in FIG. 3 or FIG. 4. Figurine body members 47 and 48 frictionally engage flexible members 44 and 45, respectively, and include second flexible member 51 and 52, respectively.

Rotatable members 44 and 45 are connected to means for rotation 53 which comprises gear train 54 having at least two gears 55 and 56 rotatable mounted with shafts 57 and 58, respectively, to which the respective flexible members are mounted. As shown in FIG. 6, spur gear 59 is utilized so that flexible members 44 and 45 rotate in the same direction. Variations in the interaction between figurines comprising bodies 47 and 48 can be achieved by different gear ratios of gears 55 and 56 or by omitting spur gear 59 which would cause members 44 and 45 to rotate in opposite directions. Alternatively, the gear means shown in FIG. 5 may be employed wherein the eccentricities of eccentric plates 35 create varying degrees of interaction during rotation. It is also clear, that any combination of eccentric plates, varying gear ratios or direction of rotation may be utilized to create the varying and unpredictable movements of the figurines.

Figure 7:
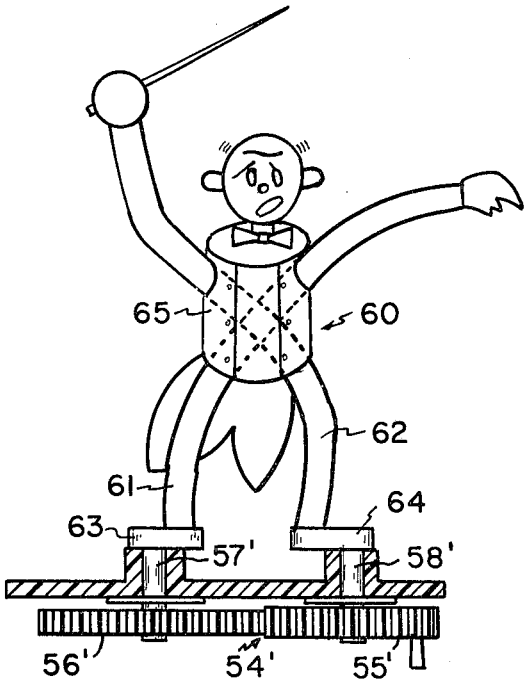
FIG. 7 is an elevation of a figurine having two rotatable members.

With respect to FIG. 7, a single figurine 60 is shown having first and second flexible members 61 and 62 each including a deformable wire (not shown). A gear means similar to that shown in FIG. 6 is used wherein each flexible member 61 and 62 is mounted to eccentric arm 63 and 64, respectively. Interaction between flexible members 61 and 62 takes place within body member 65 which may be varied by the degree of frictional engagement each member has with body member 65.

Figure 8:
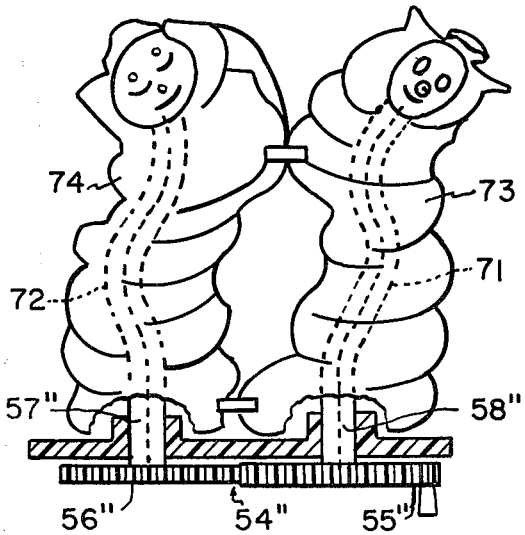
FIG. 8 is an elevation of two figurines each having a single rotatable member, but having permanently attached means for connecting the body members together.

FIG. 8, on the other hand, illustrates two rotatable flexible members 71 and 72 each having a deformable wire member extending therethrough. Interaction between the members 71 and 72 is achieved by permanently securing the body members 73 and 74 to each other. In this case, body members are of an extremely pliable material, for example, cloth, and having little or no frictional engagement with the shafts. Deformation of the flexible members provides the "shape" to the respective body members. The shape continually changes because the interaction between the bodies at the points of attachment.

While presently preferred embodiments of the present invention have been shown and described in particularity, it may be otherwise embodied within the scope of the appended claims. This is particularily the case where various of the features of one embodiment are combined with features of another.

What is claimed is:

1. A device for self-determining, unpredictable movement comprising:

a. a base having at least one opening therein;

b. a deformable, flexible member rotatably mounted to and extending from said base, said member being readily deformable and adapted to retain any deformation until a subsequent deformation occurs;

c. means mounted to said base for rotating said deformable, flexible member relative to said base and operably connected to said deformable, flexible member through said opening;

d. a body member mounted on said deformable, flexible member and frictionally engaging at least a portion of said deformable, flexible member so that, when said deformable flexible member is rotated, said body member will rotate therewith if not obstructed but may remain stationary relative thereto if obstructed; and e. obstruction means mounted to said base and positioned in the path of rotation of said deformable, flexible member or said body member to deform said deformable, flexible member.

2. A device as set forth in claim 1 wherein said deformable, flexible member comprises a flexible member having a deformable wire positioned within at least a portion of said flexible member.

3. A device as set forth in claim 1 wherein said obstruction means comprises stationary means mounted to the base and positioned thereon so that at least one of the deformable, flexible member and body member contacts said stationary means during each rotation of said deformable, flexible member.

4. A device as set forth in claim 1 wherein said obstruction means comprises a second deformable flexible member frictionally engaging said body member and adapted for rotation.

5. A device as set forth in claim 1 wherein said obstruction means comprises a second body member and a second deformable flexible member frictionally engaging said second body member and mounted to said base to position said second body member in the rotational path of said first body member during at least a portion of each revolution and means for rotating said second deformable flexible member.

6. A device as set forth in claim 1 wherein said obstruction means comprises a plurality of body members and associated deformable, flexible members frictionally engaging respective body members, each of said deformable flexible members being mounted to said base to position each of said body members in the rotational path of at least one other body member during at least a portion of each revolution said first body member, and means for rotating said deformable flexible member.

7. A device as set forth in claim 1 wherein said body member includes a second deformable flexible member adapted for engaging said obstruction means during at least a portion of the revolution of said first deformable flexible member.

8. A device as set forth in claim 1 wherein said body member comprises the torso of a figurine and said deformable flexible member comprises one of the arms and one of the legs of said figurine.

9. A device as set forth in claim 4 including a stationary means mounted to said base in the rotational path of one of said deformable flexible members.

10. A device as set forth in claim 5 wherein said first and second body members are pliable and connected at at least one point.

* * * * *

UNITED STATES PATENT AND TRADEMARK OFFICE

CERTIFICATE OF CORRECTION

PATENT NO. : 4,129,962

DATED : December 19, 1978

INVENTOR(S) : Richard Goldner

It is certified that error appears in the above-identified patent and that said Letters Patent are hereby corrected as shown below:

Column 1, line 36, after "While" delete "its" and substitute therefor -- it's --;

Column 2, line 23, after "apparent from a" delete "persual" and substitute therefor -- perusal --;

Column 3, line 4, after "Wire 17 is" delete "protruberance" and substitute therefor -- protuberance --;

Column 3, line 8, after "member 21 or" delete "proturberance" and substitute therefor -- protuberance --;

Column 3, line 20, after "member 21 or" delete "protruberance" and substitute therefor -- protuberance --;

Column 3, line 29, after "walking stick" delete "protruberance" and substitute therefor -- protuberance --;

Column 3, line 31, after "impeded by" delete "protruberance" and substitute therefor -- protuberance --;

Column 3, line 34, after "On the other hand," delete "protruberance" and substitute therefor -- protuberance --;

Column 3, line 41, after "occur when" delete "members" and substitute therefor -- member --;

Column 3, line 58, after "21 and 21' or" delete "proturberances" and substitute therefor -- protuberances --;

UNITED STATES PATENT OFFICE

CERTIFICATE OF CORRECTION

PATENT NO. : 4,129,962

DATED : December 19, 1978

INVENTOR(S) : Richard Goldner

It is certified that error appears in the above-identified patent and that said Letters Patent are hereby corrected as shown below:

Column 3, line 64, after "caused by pro-" delete "turberance" and substitute therefor -- tuberance --;

Column 4, line 18, after "Flexible" delete "member" and substitute therefor -- members --;

Column 4, line 23, after "second flexible" delete "member" and substitute therefor -- members --; and Column 4, line 36, after "of eccentric" delete "plates" and substitute therefor -- plate --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*